United States Patent [19]

Tillotson

[11] Patent Number: 4,512,620

[45] Date of Patent: Apr. 23, 1985

[54] MASS TERMINATION ELECTRICAL CONNECTOR

[75] Inventor: John D. Tillotson, Southfield, Mich.

[73] Assignee: Elco Corporation, El Segundo, Calif.

[21] Appl. No.: 468,418

[22] Filed: Feb. 22, 1983

[51] Int. Cl.[3] ..... H01R 4/24; H01R 13/41

[52] U.S. Cl. ..... 339/97 P; 339/221 M

[58] Field of Search ..... 339/97 R, 97 P, 98, 339/99 R, 96, 221 R, 221 M

[56] References Cited

U.S. PATENT DOCUMENTS

| | | | |
|---|---|---|---|
| 3,162,501 | 12/1964 | Wahl | 339/98 |
| 3,631,381 | 12/1971 | Pittman | 339/221 M X |
| 3,758,935 | 9/1973 | Long et al. | 29/203 MW |
| 3,845,455 | 10/1974 | Shoemaker | 339/97 |
| 3,845,535 | 11/1974 | Over | 29/203 MW |
| 4,026,629 | 5/1977 | Dechelette et al. | 339/97 P |
| 4,035,049 | 7/1977 | McKee | 339/97 R |
| 4,040,702 | 8/1977 | McKee, et al. | 339/97 R |
| 4,066,316 | 1/1978 | Rollings | 339/97 R X |
| 4,099,822 | 7/1978 | Calisle et al. | 339/98 |
| 4,125,311 | 11/1978 | Hoppe, Jr. | 339/97 R |
| 4,153,324 | 5/1979 | Kukla | 339/97 R |
| 4,220,390 | 10/1980 | Cobaugh et al. | 339/97 R |
| 4,220,393 | 9/1980 | Ammon et al. | 339/221 M |
| 4,286,837 | 9/1981 | Yasutake et al. | 339/176 MP |
| 4,346,955 | 8/1982 | Chesnais et al. | 339/97 R |
| 4,441,779 | 4/1984 | Foederer et al. | 339/99 R |

*Primary Examiner*—John McQuade
*Assistant Examiner*—Steven C. Bishop
*Attorney, Agent, or Firm*—Body, Vickers & Daniels

[57] ABSTRACT

An improved electrical connector and connector system is disclosed which allows for the simultaneous mass connection of multiple isolated electrical circuits through means of a single connector assembly. A standardized connector housing has multiple terminal cavities therein, each cavity being capable of containing one or more isolated electrical terminals of various disclosed configurations. The terminals disclosed are generally flat and have a slit therein from the top end to accept and hold an insulated wire in a range of gauges and make electrical connection to the conductive core of the wire upon force fitting of the wire into the slit. In one configuration the top portion of the terminals and the slit therein are centered on the terminal so that two terminals can be inserted into a single cavity and a single connecting wire can be easily aligned with, held by and electrically connected to both of the individual terminals. In a second configuration, the top portion and the slit is offset from the center of the terminal so that a different wire can easily be connected to each of the terminals in a single cavity.

16 Claims, 17 Drawing Figures

FIG. 6
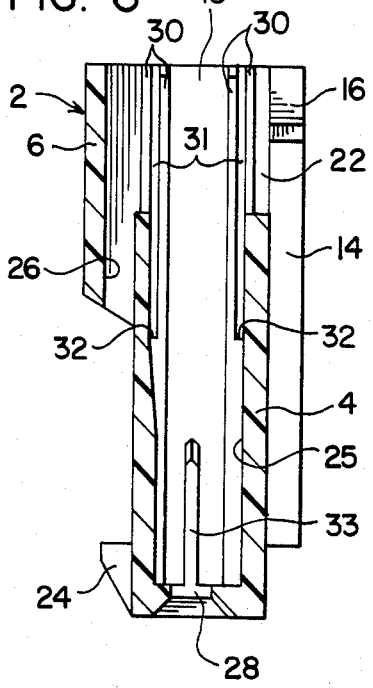
FIG. 7
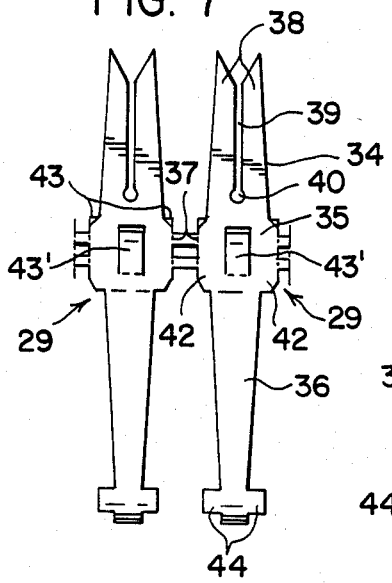
FIG. 8
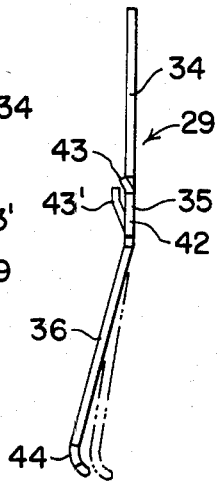
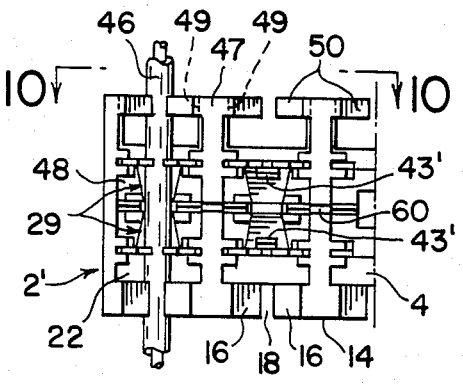
FIG. 9
FIG. 10
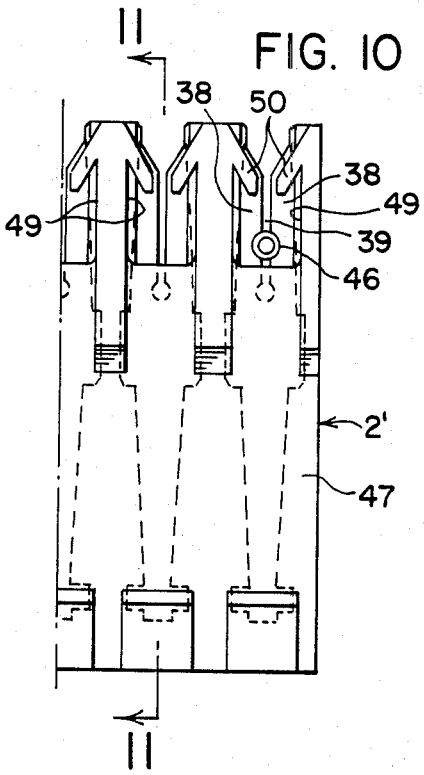

MASS TERMINATION ELECTRICAL CONNECTOR

BACKGROUND OF THE INVENTION

Field of the Invention

This invention relates generally to the field of electrical connectors, and more particularly relates to the field of electrical connectors for the simultaneous, isolated mass connection of individual multiple electrical circuits through a single connector assembly.

It is common practice in many industries utilizing electrical or electronic devices or equipment to make various electrical connections between different circuits or devices through mass termination connectors. These mass termination connectors generally comprise a housing made of an insulating material such as plastic, and have provision to retain multiple connecting terminals. The terminals are arranged in a predetermined pattern and have wires from different circuits individually connected to different ones of the terminals. The pattern of the terminals in the housing mates, for example, to multiple connecting pins in a second connector housing with these pins in turn being connected through wires to additional circuits or devices to be interconnected. After assembly of the terminals and pins onto their respective housings, and attachment of the proper wire to each of the terminals and pins, connection between the individual pins and terminals is made by engagement of the two assemblies in mating fashion so that individual pins and terminals come into electrical contact with each other along an insertion axis.

The use of such connectors allows various subcomponents of equipment to be manufactured in their component parts and to be quickly connected together at a later time, or to be disconnected for repairs, the later addition or change of components parts, and the like.

It has long been the object of the manufacturers of these connectors to provide a connector which can simultaneously connect many circuits in the smallest possible space, but without adversely affecting the performance characteristics of the connectors, such as the current carrying capacity, dielectric characteristics, mechanical strength and durability, and versatility. As in all industries, the manufacturers have attempted to devise a connector wherein standardized parts can be used in order to provide a customer with a device particularly adapted to its needs, but without the necessity of stocking a large inventory of specialized parts or the necessity of having to use more than one connector to comply with the needs of individual customers.

In general, different users of connectors require a different number of connections in a particular application, and possibly require a different current rating for individual connections. One of the approaches taken in the past by manufacturers to provide a user with an adequate current rating for each connection was to provide a connector wherein each of the individual connections had the same current rating and therefore all were made for the highest rating required in the connector. This added unnecessary cost to the customer in that the customer was paying for a more expensive connection for each terminal, when it actually only needed the high current rating for one or a few of the connections.

An alternate approach to solve the same problem was to use different terminals for various connections in the connector. However, this approach had the drawback of forcing the manufacturer to stock many different types of terminals, and required a procedure to select the various terminals and insert them in the proper position in the connector. All of this merely added to the cost of manufacturing the connectors, and in the long run may have saved very little as opposed to simply providing an overrated connector.

A further drawback of the prior art connectors was in the configuration of the housing and the terminals themselves. In general, either the housings or the terminals or both were complex and required more expensive tooling and assembly procedures than was desirable. For example, the terminals themselves were many times complex in shape and required intricate or multiple bending operations which added cost, complexity, and fatigue points to the terminals.

Thus, there has been need for a connector assembly with reduced complexity, but which has versatility, relatively low cost, and which can utilize a small number of different standardized parts to provide a wide range of connectors adaptable to various requirements such as the number of circuits connected and the current rating of individual connections.

SUMMARY OF THE INVENTION

In accordance with the foregoing then, there is provided by the present invention an improved mass termination connection system and connector. Similar to some prior art connectors, the assembly includes a standardized molded housing having multiple terminal cavities therein to receive and hold connecting terminals. One end of each terminal is adapted to be connected to a wire from a desired circuit, and the opposite end of the terminal is adapted to be connected to a mating or complementary contact terminal of a second connector.

However, in the present invention, a new terminal configuration and terminal cavity configuration are provided which allow a small number of different parts to be combined to make different connections for a wide variety of different applications.

Each cavity of the housing is adapted to mechanically receive and hold by friction one or more terminals having different configurations. Two specific such terminals are disclosed. Depending on the type and number of terminals used in any particular cavity, that cavity can be adapted to make a circuit connection through one terminal for lower current applications, through more than one terminal for higher current applications, or two different isolated connections can be made through the same cavity.

In general, each cavity of the housing has means to retain or hold more than one terminal. In the preferred embodiment, means is provided to hold two of such terminals, each being offset from the center of the cavity and from the insertion axis for the connecting pin from the second housing. This holding means includes channels on two opposed inner side walls of the cavity which receive flanges on the terminals to be used therein. The cavity and channels are open at a top portion so that terminals can be inserted therein and held by friction fit.

The terminals are made in two preferred configurations, but both configurations are compatible with insertion into the channels on the inner walls of the cavity. In general, both configurations have a flat, somewhat thin-walled upper wire connection portion, an intermediate flanged portion, and a lower contacting portion inclined outwardly from the plane of the flat upper portion toward the center of the cavity as inserted therein. The flanges on the intermediate portion fit into the channels as stated above to hold the terminals in the cavity.

In both of the preferred configurations the upper wire connection portion of the terminals has an open slit therein extending from the top of the terminal toward the lower connecting end, which forms the upper portion of the terminal into two tines. The slit is of uniform width substantially throughout except for a relief hole at its lowermost part, and an increasing width at its uppermost part. The slit is adapted thereby to have an insulated wire laterally inserted thereinto to cause the tines to sever the insulation, and make an electrical connection to the conductive core of and hold the wire between the tines under tensioned friction fit.

The basic difference between the two preferred configurations of the terminals relates to the position of the slit in their upper end. In one configuration, the slit in the top of the terminal is in the center thereof so that when two terminals are inserted into a single cavity of the housing, facing each other in parallel adjacent relation, the slits of the two respective terminals are in line and lie in a common plane perpendicular to the plane defined by the upper portions thereof. In this configuration, both of the terminals can easily be connected to the same wire. Thus, in this configuration, the contact surface area between the wire and the two terminals is comparatively increased over a situation where only a single terminal is used in a cavity, and therefore, the current rating for the connection in that cavity is also comparatively increased.

In a second configuration, the slit and the top portion of the terminal are offset from the center thereof so that when two of these terminals are inserted into a single cavity facing each other in parallel relation, the respective slits are offset from each other and from the center of the cavity, and lie in different planes perpendicular to the planes defined by the upper portions of the terminals. In this configuration, a different wire can be connected in an isolated manner to each of the terminals in one cavity, thus increasing the connection density of the connector assembly. With respect to this configuration, insulating separator studs are located at the bottom of the cavity to prevent contact of the lower portions of the two terminals. Also for this configuration, pins are used in the mating connector housing, wherein two opposite sides of the pin are insulated from and separate from each other.

Thus, there is provided a mass connector system which includes a housing capable of accepting into each terminal cavity different configurations of terminals. Each cavity can therefore be used with one terminal for lower current connections, two terminals for higher current connections, or can be used for connecting two isolated circuits in a single terminal cavity, and with each individual cavity in the housing being arranged independently of the others. The terminals themselves are of simple design, and without complex contours or intricate bending procedures to manufacture them.

It is therefore an object of certain aspects of this invention to provide a connector housing which is compatible with multiple varied terminals and which is adaptable to have different connection characteristics in each terminal cavity with only a small number of different parts to stock.

It is an object of other aspects of this invention to provide a connector housing and terminals which are versatile, but yet simple in design, manufacture and assembly.

It is an object of still other aspects of this invention to provide such a connector assembly which has its terminals inserted and held mechanically, and has provision for making mechanical connection to wires, but yet with simple tooling, machinery, and assembly procedures.

These and other objects of various aspects of the invention will become apparent to those skilled in the art upon reading the following description of the preferred embodiment in conjunction with the drawings in figures in which:

BRIEF DESCRIPTION OF THE DRAWINGS

FIG. 6 is a cross-sectional view of the housing member of the connector shown in FIG. 1;

FIG. 7 is a front elevational view on an enlarged scale of terminals used in the connector of FIGS. 1-6 as they are manufactured;

FIG. 8 is a side elevational view of the terminals shown in FIG. 7;

FIG. 9 is a top view on an enlarged scale of an alternate embodiment of the connector comprising the invention as adapted for a feed-through connection of wires;

FIG. 10 is a fragmentary rear elevational view of the connector shown in FIG. 9 taken on the line 10—10 thereof;

DESCRIPTION OF THE PREFERRED EMBODIMENT

Figure 1:
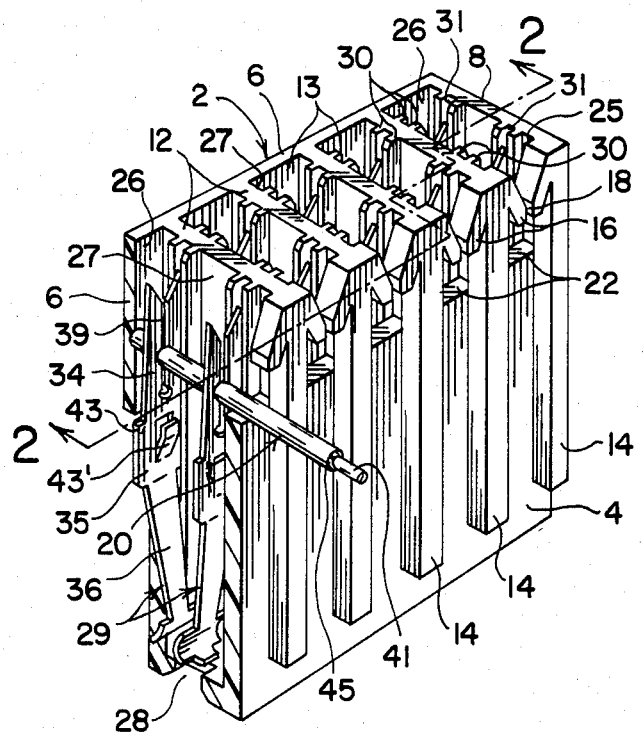
FIG. 1 is a perspective view on an enlarged scale of a preferred embodiment of mass connector comprising the invention.
Figure 2:
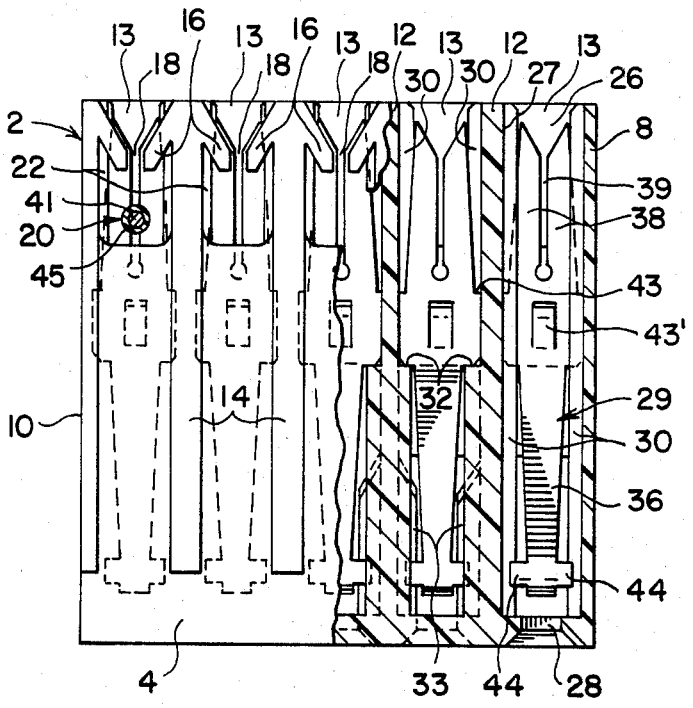
FIG. 2 is a front elevational view on an enlarged scale and partly in section on the line 2-2 of FIG. 1 of the connector therein shown.

FIGS. 1–6 depict a connector to be used in conjunction with a second or mating connector or header for the simultaneous connection of multiple electrical or electronic circuits or devices. Although a second connector or header is required in use, and although various parameters relating to a second connector will be referred to below, the second connector can take on various forms which will be readily appreciated by those skilled in the art, and therefore a detailed description of such a mating connector is not needed herein.

The connector comprising the invention includes a terminal housing 2 which is generally rectangular, having a front wall 4, a back wall 6, two end walls 8 and 10 respectively, and multiple internal separating walls 12 forming multiple terminal cavities 13 therebetween. The outside of the front wall 4 has ridges 14 at each junction of the separating walls 12 with the front wall 4 and extending from the top to almost the bottom of the housing 2. These ridges 14 serve to guide the mating connector or header (not shown) and help position it when the two connectors are brought together. There are downward angled tabs 16 at the top end of each of the ridges 14 on either side thereof, together giving the appearance of blunt arrows. There is a gap 18 between the lower ends of adjacent tabs 16 to allow and facilitate the connection of wires 20 to the connector as will be more fully described hereinafter. There are also openings 22 in the top part of the front wall 4 between each adjacent separating wall 12 for the passage of connecting wires 20 therethrough. The back wall 6 of the housing 2 is contoured to accept the mating connector or header, and has retaining stubs 24 at distributed points along the lower parts to engage complimentary structure on the mating connector and hold the two connectors together.

The terminal cavities 13 are all basically identical, and therefore only one will be described in detail, with the single description applying to each of them. The cavities 13 are generally rectangular as viewed from the top as can best be seen in FIG. 3, and are defined between a front wall 25, and back wall 26, and between opposed side walls 27 formed by successive separating walls 12. The cavities 13 extend from top of the housing 2 to the bottom thereof, are open at their top end and have an opening 28 in the bottom for the insertion of a connecting pin from the mating connector or header along an insertion axis in the center of the bottom opening 28. The open top portion of the cavity 13 allows terminals 29 to be inserted thereinto, and thereafter allows wires to be connected to the terminals 29 as will be described in detail below.

Figure 3:
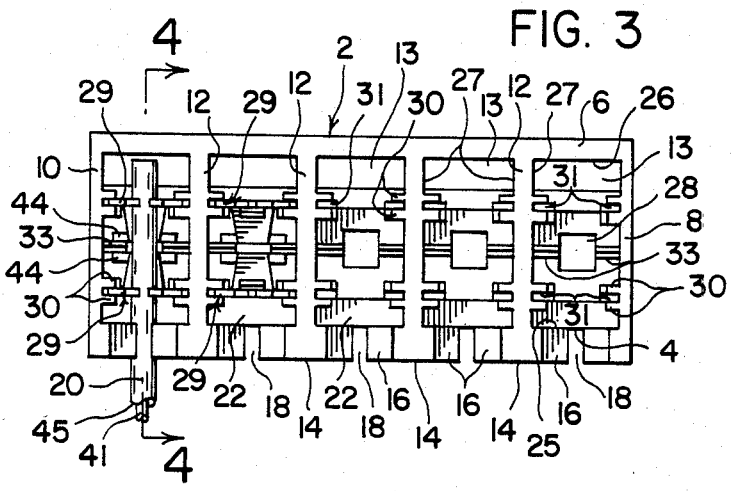
FIG. 3 is a plan view of the connector shown in FIG. 1 but with the terminals removed from the three rightmost terminal cavities of the connector housing.
Figure 4:
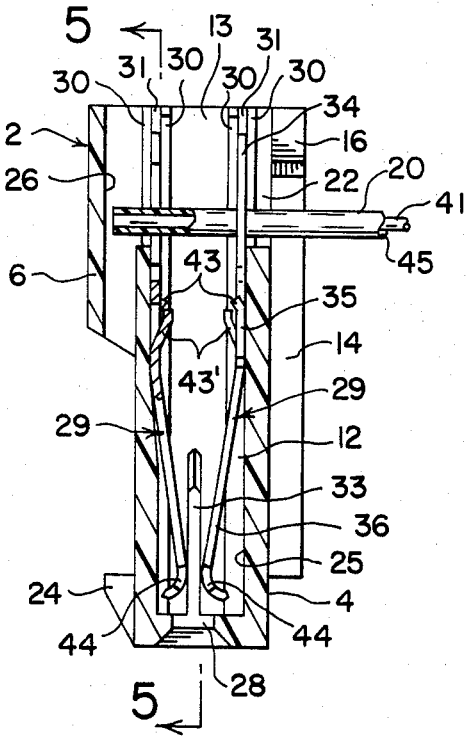
FIG. 4 is a cross-sectional view of the connector taken on the line 4—4 of FIG. 3.
Figure 5:
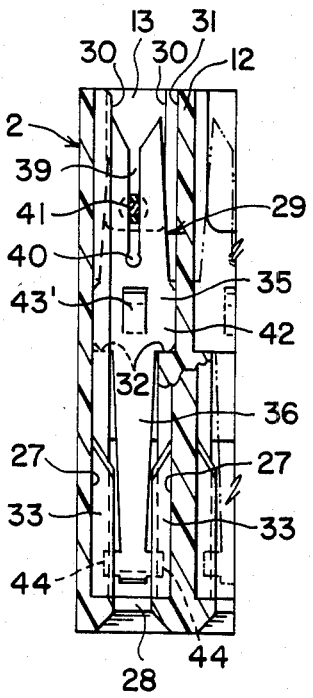
FIG. 5 is a cross-sectional view of the connector taken on the line 5—5 of FIG. 4.

As can be most readily seen in FIGS. 1, 3, and 6, there are two pairs of ribs 30 on the inside of each side wall 27 in each cavity 13. Each pair of ribs 30 forms a terminal retaining channel 31 therebetween. The channels 31 extend partway down the side wall 27 and have a lowermost bottom end 32 forming a shoulder at an intermediate location between the top and bottom of the cavity. Each channel 31 is offset from the center of the cavity 13, one on each side to the front and rear respectively. The two channels 31 on opposite side walls 27 offset to the rear of the cavity 13 lie in a first common plane laterally displaced to the rear of the insertion axis of the cavity, and the two channels 31 offset to the front of the cavity 13 lie in a second common plane displaced laterally to the front of the insertion axis of the cavity 13. The front pair and rear pair of channels 31 are both designed to retain separate terminals 29 in spaced apart relationship to each other, as will be more fully described below.

At the bottom of the cavity 13 and extending outwardly from each side wall 27 are insulating separating studs 33. Each stud 33 is aligned with the insertion axis and extends into the cavity 13 from the side wall 27 only to the edge of the opening 28 at the bottom of the cavity 13. As will be appreciated more fully hereinafter, when the front and rear pairs of channels 31 in a particular cavity 13 both retain a separate terminal 29, the separating studs 33 keep the lower portions of the two terminals 29 apart.

Referring now to FIGS. 7 and 8, the structure of one preferred embodiment of terminals 29 for use in the housing 2 of FIGS. 1–6 can be understood. The terminals 29 are made of a suitable electrically conductive material such as brass, for example, and they are elongated between a lower and upper end and are generally flat. Each terminal 29 comprises a flat, thin-walled upper portion 34 defining a plane, an intermediate flanged portion 35 also lying in said plane, and a laterally inclined lower contact or connection portion 36. As can be seen in FIG. 7, a strip of multiple ones of such terminals 29 can be cut or stamped by common methods, and thereafter separated into individual terminals 29 by cutting; as for example at the position marked by the dashed line 37 in FIG. 7. After separation, the upper portion 34 of the terminal 29 has two tines 38 formed by an elongated central wire termination slit 39 open at the top and extending toward the lower end of the terminal 29 to about the top of the intermediate flanged portion 35. The slit 39 is generally of uniform width throughout its length, but having a circular shape at the bottom 40 and tapering outwardly at the top. When used in the housing of FIGS. 1–6, the slit 39 receives and the tines hold by force fit a wire 20 from the circuit to be connected and make electrical contact to the conductive core 41 of the wire 20. The circular bottommost part 40 of the slit 39 provides relief for the tines 38 so that when a wire 20 is inserted into the slit 39 the tines 38 can resiliently be separated to receive, hold and make contact to the wire 20. The outwardly tapering uppermost part of the slit 39 facilitates the insertion of the wire 20 as will be more fully described below in regard to the assembly of the terminals 29 into the housing 2 and the connection of wires 20 to the terminal 29.

Retaining flanges 42 extend outward to both sides of the terminal 29 at an intermediate location between the top and bottom of the terminal, and lie in the plane of the upper portion 34 thereof. The flanges 42 are generally rectangular in shape in the plane of the upper portion 34 of the terminal 29, and each flange 42 has an upper corner bent laterally from said plane to form prongs 43 thereon. A tang 43' is pressed out from the intermediate flanged portion 35 of each terminal 29 approximately centrally thereof and has its upper end offset a slight distance to the same side of the plane of the intermediate portion 35 as the prongs 43 thereon. The offset tang 43' affords a convenient abutment shoulder on the terminal 29 for engagement by a suitable tool employed to insert the terminal in the channels 31 of the housing 2.

The bottom portion 36 of the terminal 29 tapers gradually as it extends downward from the retaining flanges 42. Close to the bottom of the terminal there are two connectors or contact flanges 44 extending outward therefrom on either side. As can best be seen in FIG. 8, the lower portion 36 of the terminal is bent at the lower part of the retaining flanges so as to be inclined laterally from the plane of the upper part 34 of the terminal 29. The bottommost part of the terminal is curved at the contact flanges back towards the plane of the upper part. It is curved about an axis parallel to the plane of the upper part of the terminal, and perpendicular to the elongated direction of the terminal 29, to facilitate insertion of the mating connector pin from the second connector or header.

After separating individual terminals 29 from the strip, one or two of them are inserted into desired cavities 13 of the housing. The retaining flanges 42 on the terminals 29 are force fit into desired sets of channels 31 in the cavity 13 so that they bottom out therein against the bottom end 32 of the channel 31 with the tined end of the terminal oriented upward, proximate to the upper end of the cavity 13 and distant to be lower opening 28. A special tool can be used to facilitate insertion of the terminal 29 into the channels 31 and such a tool can be readily appreciated by those skilled in the art and need not be described in detail here. The small prongs 43 formed at the upper corners of the retaining flanges 42 dig into ribs 30 forming the channels 31 to secure the flanges 42 therein. As thus inserted, the lower curved contact flanges 44 engage the two separator studs 33 in the bottom of the cavity 13 to properly position the contacting bottom end of the terminal 29 in proximity to the bottom opening 28 and adjacent to the insertion axis. If two terminals are inserted, one each into each set of channels 31 in a particular cavity 13, the separating studs 33 also serve to keep the lower contacting portions of the two terminals 29 separated from each other.

As noted above, either one or two individual terminals 29 can be inserted into each cavity 13. If only one terminal 29 is inserted, it is inserted in either the front or rear set of channels 31 so that the lower portion 36 is inclined towards the insertion axis of the bottom opening 28 in the cavity 13. If two terminals 29 are inserted into a single cavity 13 they are inserted with both bottom portions 36 inclined toward the insertion axis of the bottom opening 28 and thus towards each other. In this configuration, the two terminals 29 will have the planes defined by their upper portions 34 adjacent and parallel with one each displaced laterally from the insertion axis in different directions and with the respective slits 39 therein aligned in a common plane perpendicularly to each of said planes.

As can be seen in FIGS. 1–4 a wire 20 from the circuit to be connected is force fit into the slit 39 of the terminal 29 such that it extends perpendicular to the plane of the upper part 34 of the terminals 29. Thus, if two terminals 29 are inserted into a single cavity 13 the wire 20 can be easily aligned with and inserted into the slits 39 of both terminals 29 simultaneously.

The wire 20 can be inserted with the aid of a wide range of small tools and such a tool can be readily appreciated by those skilled in the art and therefore need not be described in detail herein. The wire 20 is inserted into the slit 39 between the tines 38 with its insulating sheath or covering 45 running to its end. Upon insertion, the insulation 45 initially forces the tines 38 apart creating a spring tension on the wire 20. As the wire 20 is slid down into the slit 39 under this tension, the thin-walled edge of the tines 38 cuts through the insulation 45, and the tines 38 engage the conductive core 41 of the wire 20 so that there is tensioned mechanical electrical contact between the tines 38 and the conductive core 41 of the wire 20. For this purpose, the slit 39 is made of a width somewhat narrower than the conductive core 41 of the wire 20 so as to assure the spring tension contact of the tines 38 with the wire core 41.

It is pointed out here that because of the resilience of the tines 38, wires in a range of gauges can be connected to the terminals 29 and force fitted into the slit 39.

Figure 11:
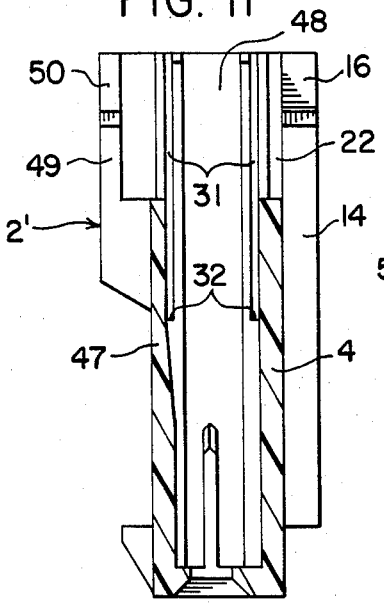
FIG. 11 is a cross-sectional view of the housing of the connector shown in FIG. 10 taken on the line 11-11 thereof.

In the configuration of the housing 2 depicted in FIGS. 1–6, the wire 20 ends inside the connector cavity 13 adjacent to the closed back wall 26 thereof. FIGS. 9–11 depict a feed-through configuration wherein the wire 46 passes completely through the upper part of the cavity, and out the back side. As can be appreciated by those familiar with the connector art, this is desirable in order to connect the same wire to other circuits or connectors as well. In the configuration of FIGS. 9–11, the basic housing structure 2' can be identical to the connector depicted in FIGS. 1–6 with the exception of the back wall 47 of the cavity or cavities 48. In such a configuration, the back wall 47 of the cavity 48 is made to be identical to the front wall 4 at the upper portion, having wire openings 49 therethrough and guide tabs 50 on the sides of each opening 49. The wire 46 in this case passes through the front opening 22, is connected to the terminal or terminals 29 therein, and passes out of the opening 49 in the back wall 47. Since the remainder of the structure is identical to the structure of the embodiment as depicted in FIGS. 1–6, no additional description is needed here for a complete understanding of it.

Figure 12:
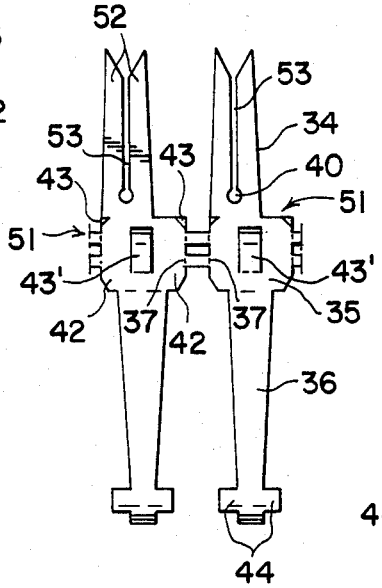
FIG. 12 is a front elevational view of an alternate configuration of terminals as they are manufactured, for use with the various connector housings of the invention to permit the side by side isolated connection of two different wires in single ones of the housing cavities.
Figure 13:
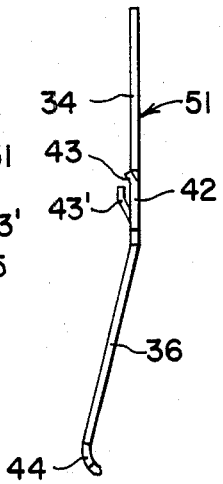
FIG. 13 is a side elevational view of one of the terminals shown in FIG. 12.
Figure 14:
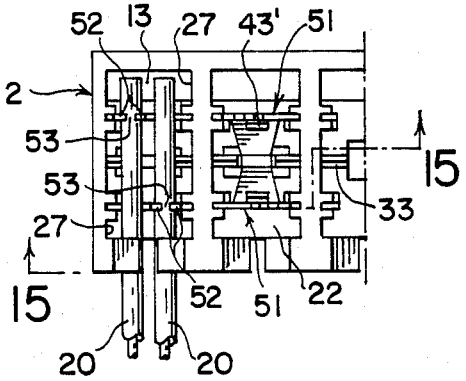
FIG. 14 is a partial plan view of an alternate embodiment of the connector comprising the invention having the terminals of FIGS. 12 and 13 installed in two of the connector housing cavities, and with separate wires connected to individual terminals in one of the cavities.
Figure 15:
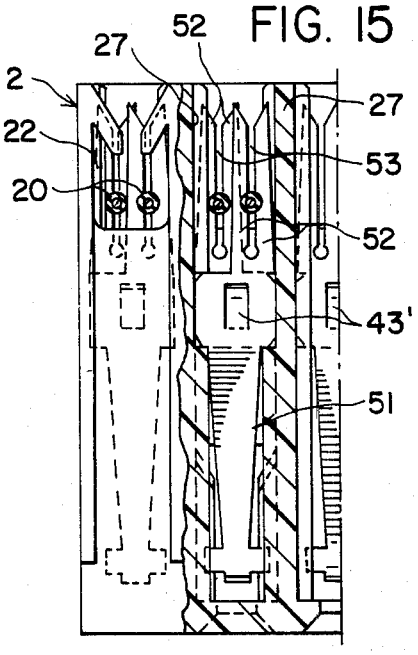
FIG. 15 is a front elevational view of the connector shown in FIG. 14 partly taken on the line 15—15 thereof.

FIGS. 12 through 15 depict still another alternate embodiment of the connector of the present invention wherein two separated isolated circuits can be connected through a single cavity 13 to thus increase the connection density of the connector assembly. The housing in this embodiment can be identical in configuration to the housing depicted in either FIGS. 1–6 or 9–11. The difference in this connector lies in the configuration of the terminals 51 that have been inserted into the cavity 13. As can be seen in FIG. 13, the shape of the terminals as viewed from the side can be identical to the terminals 29 depicted in FIGS. 7 and 8. However, as can be best seen in FIG. 12, although the terminals 51 can still be made or stamped in a strip, and the individual terminals later separated along the dashed lines 37, it can be noted that the tines 52 of the terminals 51 and the slit 53 that forms them are offset from the center of the terminal 51.

The terminals 51 depicted in FIGS. 12 and 13 have special application when two are used in a cavity 13. In this situation, as can best be appreciated with reference to FIGS. 14 and 15, each of the two terminals 51 is inserted in the cavity 13 so that the lower part of each terminal 51 is inclined toward the center of a cavity 13 when the terminals 51 are thus turned to face each other with the flat surfaces of their upper portions adjacent and parallel. The slits 53 on both terminals 51 will be offset from the center of the cavity 13 one each toward opposite side walls 27, and each of the slits 53 will lie in a different plane perpendicular to the flat surfaces of their upper portions. Because of the amount of offset, in combination with the dimension of the cavity 13 and side wire opening 22, there is sufficient room around each upper portion of the terminals 51 and through the opening 22 for two insulated wires 20 to pass, side by side. Therefore, as noted above, since the separating studs 33 in the lower part of each cavity 13 keep the terminals 51 apart, each individual terminal 51 can be connected to an isolated wire 20 and independently connect two separate circuits.

As can be appreciated from FIG. 12, the outer edge of the left tine 52 as depicted extends at its lower portion out as far as the flange 42. However, it is noted that the tines 52 angle inward as they approach the top of the terminal 51 so that the left tine 52 can resiliently be displaced sideways in the retaining channel for the eventual insertion of a wire between the tines.

In the configuration of FIGS. 12–15, a special connecting pin is used at the corresponding position of the mating connector or header. In general, the pin would have two conducting sides aligned one each with the respective lower portions of the individual terminals 51 and each such side of the pin would be insulated from the other. The details of such a pin are not described herein since they form no part of the present invention.

Figure 16:
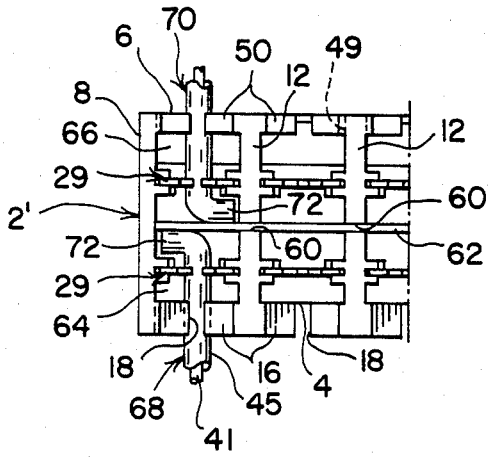
FIG. 16 is a plan view similar to FIG. 9 of an alternate embodiment of the connector therein shown adapted for connecting two different wires in isolated relation to separate ones of the two terminals in single ones of the housing cavities; and, FIG. 17 is a fragmentary isometric view of the connector shown in FIG. 16.
Figure 17:
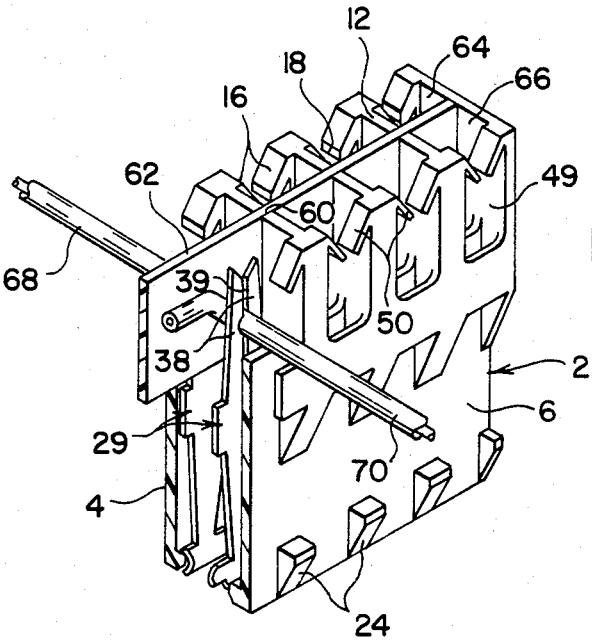

FIGS. 16 and 17 illustrate a preferred alternate form of connector comprising the invention for connecting two separated isolated electrical circuits within a single cavity 13 of the housing. The housing 2' in this case may be the same as that employed in the embodiment of the invention illustrated in FIGS. 9–11 for the feed-through connection of a single wire 46 completely through the upper part of the cavity 48, the back wall 47 of the cavity being provided in such case with the wire openings 49 therethrough and guide tabs 50 for the reception of a single wire 20 within each cavity. As shown, the separating walls 12 which form the multiple terminal-receiving cavities 48 of the housing 2' are each formed at their upper end with a cross-slot 60 which are all located centrally between the front and back walls 4, 6 of the housing and aligned with one another. In the form of the invention shown in FIGS. 16 and 17, these slots 60 receive, in a tight-fitting manner, a thin insulator strip 62 of indurated synthetic plastic. The insulator strip thus divides each cavity 48 into two separate and distinct subcavities 64 and 66 for the isolated reception therein of separate circuit wires 68 and 70, respectively, as shown in FIG. 16. The slots 60 are of a depth, extending down from the top edges of the cavity walls 12, more or less corresponding to the depth of the openings 22 and 49 in the front and back walls 4 and 47 of the housing 2', and the insulator strip 62 is of a width corresponding to the slot depth so that when fully inserted down into the slots 60, the strip will completely block off the subcavities 64 and 66 from one another in a direction from front to back of the housing 2'.

In the connecting of each individual wire 68, 70 to the terminal 29 in a respective one of the subcavities 64, 66, the wire is placed within and across the entrance end of the slit 39 in the terminal 29, preferably with a short free end portion 72 of the wire bent at right angles and inserted in the space between the terminal 29 and the insulator strip 62 and bearing thereagainst, as shown in FIG. 16. The wire 68 or 70 is then forced down into the slit 39 between the tines 38 of the terminal 29 to spring them apart and cause the tines to cut through the insulating sleeve 45 and thus electrically contact with the conductive core 41 of the wire. The forcing of the wire 68 or 70 into the slit 39 of the terminal 29 is preferably accomplished with a suitable inserting tool (not shown) which engages and presses down against the wire at points located immediately adjacent each flat side of the terminal 29 so as to assure a good transverse cutting of the wire insulation sleeve 45 by the tines 38 and thus a good electrical contact thereof with the conductive core 41 of the wire.

It is noted that either of the housings 2 or 2' of FIGS. 1–6 or 9–11 can be used with either of the terminals of FIGS. 7 and 8 or 12 and 13 and therefore it can be appreciated that each individual cavity of either housing can accept any of the terminal configurations disclosed herein.

In view of the foregoing, then, it can be appreciated that a mass termination electrical connection system has been disclosed which is versatile, simple in design and assembly, and with each cavity being adapted to satisfy a wide range of individual connection requirements with respect to current rating, wire size, and connection density by the selective combination of only a few standardized parts. Many modifications to the invention will be apparent to those skilled in the art without departing from the scope of the invention, and it is intended that I be limited only by the appended claims.

Having described my invention, I claim:

1. An electrical connector comprising a housing of insulating material having a front wall and a rear wall extending approximately parallel to each other and joined together at their opposite ends by side end walls to form an enclosure therebetween, said housing further having at least one divider wall extending between and joined to said front and rear walls to divide said enclosure into a plurality of separate side-by-side terminal receiving cavities opening upwardly and having respective downwardly open lower passageway portions extending along respective insertion axes from a second mating connector, said front and rear walls having wire-receiving notch openings extending downwardly from the top edges thereof and communicating with respective ones of said cavities for lateral passage of wire conductors thereinto transversely of said front and rear walls, and insulating separator strip adapted to be fitted in an aligned row of cross slots in the upper edges of said housing divider walls to extend approximately parallel to and centrally between said front and rear housing walls and across the said housing cavities to subdivide each one thereof at its upper end into a pair of subcavities for receiving separate said wire conductors therein, and a pair of elongated terminals supported in separated but adjacent relation in each respective one of said cavities by respective retaining means therein and each having a lower contact leaf portion extending downwardly through the respective said lower passageway portion thereof, said contact leaf portions of each said pair of terminals in each said cavity being disposed in opposed relation to one another within the said lower passageway portion of the respective cavity below the said separator strip therein for receiving therebetween and electrically engaging a repsective connector pin of said mating second connector, said terminals each having a flat, upper, wire termination portion, the said wire-termination portions of each said pair of terminals in each said cavity extending into and being disposed in respective ones of the said subcavities thereof in approximately parallel relation to each other and to said separator strip on opposite sides thereof and spaced therefrom, each of said terminals having a wire-receiving slit in the said wire-termination portion open at the upper end thereof and dividing said wire-termination portion into a pair of wire-grippable spring tines, and the said wire-receiving slits of each said pair of terminals in each respective said cavity lying in a common plane approximately perpendicular to the planes defined by the said flat wire-termination portions of the respective pair of terminals.

2. A connector as defined in claim 1 wherein said housing is provided with retaining means withing said cavities for holding a respective pair of said terminals therein in separated but adjacent relationship to each other.

3. A connector as defined in claim 2 wherein the said retaining means comprises two pairs of opposed channels on the opposed side walls of each one of said cavities, each said pair of opposed channels extending upwardly into a respective one of the said subcavities of the respective cavity and being open at the top for slidably and bindingly receiving one of the said terminals to hold it in place in said housing.

4. A connector as defined in claim 3 wherein the said terminals are each provided with a flat terminal-retaining portion located intermediate the upper and lower terminal ends and lying in the plane of the said flat, upper, wire termination end of the terminal, said flat terminal-retaining portion having flat side flange extensions projecting laterally outward from the opposite side edges of the terminal and slidably inserted in and bindingly engaged with the walls of the respective said pair of channels to retain the terminal in place therein.

5. A connector as defined in claim 1 wherein the said housing is provided with separating stud means within the said lower passageway portion of each said cavity at the lower end thereof to maintain the said lower contact leaf portions of the two said terminals in each said cavity separated from each other while allowing insertion therebetween of a connector pin from a mating connector.

6. An electrical connector comprising: a one-piece housing of insulating material having front and rear vertical walls, a top end, and a bottom end wall, said housing being provided with a vertically extending cavity open at the top end of the housing and defined by vertical inner wall surfaces of said front and rear walls and by opposed vertical side wall surfaces of transverse walls extending between said front and rear walls, said cavity having a vertically extending center axis; a first pair of opposed, vertically extending, terminal retaining channels on said opposed side wall surfaces of said cavity, said pair of channels being formed at least in part by protruding vertical ribs on said opposed side walls surfaces and being offset to one side of the said center axis of said cavity toward one of said housing front and rear walls and having open upper ends exposed at the top end of said housing and closed lower ends located within said cavity to provide terminal engaging stop shoulders therein; and an elongated terminal of flat metal strip material supported in and extending generally vertically through said housing cavity, said terminal having a flat terminal-retaining intermediate portion, a flat conductor-termination upper portion extending upwardly within said cavity and provided with a longitudinal wire termination slit extending vertically of said cavity and having an open upper end, and a generally flat lower contact leaf portion laterally inclined to the common plane of the said flat intermediate and upper portions of the terminal, said flat intermediate terminal portion having flat side flange extensions projecting from the opposite side edges thereof and providing downwardly facing abutment shoulders thereon; said side flange extensions being slidably force-fitted into the said pair of opposed channels in the housing cavity to retain the terminal in fixed upright and oriented position within the cavity with the said abutment shoulders on the terminal engaged with the said stop shoulders in the said channels to locate the terminal in predetermined vertical position within the cavity with the said lower contact leaf portion of the terminal inclined toward the said center axis of the housing cavity; at least one of said housing front and rear walls having an upwardly open notch opening therethrough extending vertically downward from the top end of the housing and coextensive with a portion of the length of and located opposite the slit in said inserted terminal for permitting transverse translational passage thereinto and forced entry into the said wire termination slit in said terminal of a wire conductor for electrical connection thereto.

7. A connector as defined in claim 6, wherein the said housing is provided with a second pair of said opposed terminal receiving channels on said opposed side wall surfaces of said cavity but offset to the other side of said cavity center axis; and a second terminal identical to said first terminal is inserted and retained in said second pair of channels in a position abreast of said first terminal with the said abutment shoulders on said second terminal engaged with the said stop shoulders in the said second pair of channels and with the plane defined by the flat intermediate and upper portions of said second terminal parallel to the plane of the flat intermediate and upper portions of said first terminal, and with the inclined contact leaf portion of said second terminal inclined toward the said center axis of the housing cavity.

8. A connector as defined in claim 6, wherein each of said front and rear walls of said housing is provided with one of said upwardly open notch openings for accommodating a wire conductor therein.

9. A connector as defined in claim 7, wherein each of said front and rear walls of said housing is provided with one of said upwardly open notch openings.

10. A connector as defined in claim 6, wherein the said flat intermediate portion of the terminal has a tang pressed out and extending upwardly therefrom at a location generally centrally thereof and having its upper end offset to the same side of the plane of said flat intermediate portion as the said contact leaf portion of the terminal in inclined therefrom, the said offset upper end of the tang providing an upwardly facing terminal-inserting shoulder means exposed upwardly within the said housing cavity for engagement by a terminal inserting tool to forceably slidingly insert the terminal downwardly into the said terminal retaining channels in said housing cavity and effect engagement of the said abutment shoulders on the terminal with the said stop shoulders in said channels.

11. A connector as defined in claim 7, wherein the said flat intermediate portion of each of said first and second terminals has a tang pressed out and extending upwardly therefrom at a location generally centrally thereof and having its upper end offset to the same side of the plane of said flat intermediate portion as the said contact leaf portion of the respective terminal is inclined therefrom, the said offset upper ends of the said tangs on said terminals providing upwardly facing terminal-inserting shoulder means exposed upwardly within the housing cavity for engagement by a terminal inserting tool to forceably slidingly insert the said terminals downwardly into respective ones of said pairs of terminal retaining channels in said housing cavity and effect engagement of the said abutment shoulders on the terminals with the said stop shoulders in said channels.

12. A connector as defined in claim 6, wherein the said flat side flange extensions of said flat intermediate portion of the terminal are formed with sharp pointed outer end corner portions at their upper ends which corner portions are bent outwardly at a slight angle to the plane of the said intermediate portion of the terminal so as to dig into the walls of the said housing channels and retain the terminal in place in inserted position within the housing cavity.

13. A connector as defined in claim 7, wherein the said wire-termination slits of said first and second terminals lie in a common vertical plane perpendicular to the parallel planes defined by the flat upper portions of said terminals.

14. A connector as defined in claim 7, wherein the said wire-termination slits in said first and second terminals lie in different vertical planes perpendicular to the parallel planes defined by the flat upper portions of said terminals.

15. A connector as defined in claim 7, wherein the said opposed side wall surfaces of said housing cavity are provided with projecting stud means at the lower end of the cavity for engaging between and maintaining the said contact leaf portions of said first and second terminals separated from each other while allowing insertion therebetween of a connector pin from a mating second connector through an opening in said housing bottom end wall.

16. A connector as defined in claim 14, wherein the said opposed side wall surfaces of said housing cavity are provided with projecting stud means at the lower end of the said housing cavity for engaging between and maintaining the said contact leaf portions of said first and second terminals separated from each other while allowing insertion therebetween of a connector pin from a mating second connector through an opening in said housing bottom wall.

* * * * *